United States Patent [19]

Yamashita et al.

[11] Patent Number: 4,496,240

[45] Date of Patent: Jan. 29, 1985

[54] APPARATUS FOR CONTROLLED DELIVERY OF MAGNETIC TONER

[75] Inventors: Keitaro Yamashita, Saitama; Hiromi Kashiwagi, Kumagaya, both of Japan

[73] Assignee: Hitachi Metals, Ltd., Japan

[21] Appl. No.: 541,492

[22] Filed: Oct. 17, 1983

Related U.S. Application Data

[63] Continuation of Ser. No. 298,172, Aug. 31, 1981, abandoned.

[30] Foreign Application Priority Data

Sep. 1, 1980 [JP] Japan ..... 55-120893

[51] Int. Cl.[3] ..... G03G 15/00

[52] U.S. Cl. ..... 355/14 D; 118/688; 355/3 DD

[58] Field of Search ..... 355/14 D, 3 DD; 118/688, 689, 690, 657, 658

[56] References Cited

U.S. PATENT DOCUMENTS 3,981,272 9/1976 Smith et al. ..... 355/3 DD
4,054,230 10/1977 Suzuki et al. ..... 118/689 X
4,147,127 4/1979 Terashima ..... 118/689
4,240,375 12/1980 Terashima ..... 118/689
4,270,487 6/1981 Terashima et al. ..... 118/690
4,331,184 5/1982 Terashima et al. ..... 355/3 DD

*Primary Examiner*—R. L. Moses
*Attorney, Agent, or Firm*—Finnegan, Henderson, Farabow, Garrett & Dunner

[57] ABSTRACT

A developing apparatus for developing an electrostatic latent image by means of a magnetic toner. The apparatus includes a non-magnetic cylindrical sleeve accommodating a first magnet roll and disposed to face the surface of a photosensitive roll, a developing tank for supplying the non-magnetic sleeve with the magnetic toner, and a blade disposed at the outlet of the developing tank for adjusting the thickness of the magnetic toner which is conveyed on the surface of the sleeve due to a relative rotation between the sleeve and the first magnet roll. The apparatus further includes a detector disposed at the upstream side of the blade as viewed in the direction of convey of the magnetic toner for detecting the amount of the magnetic toner, a second magnetic roll disposed at the toner outlet of a toner tank for controlling the amount of the magnetic toner supplied through the toner outlet to the developing tank, and a motor for selectively rotating the second magnetic roll in accordance with a signal produced by the detector.

3 Claims, 2 Drawing Figures

APPARATUS FOR CONTROLLED DELIVERY OF MAGNETIC TONER

This application is a continuation of application Ser. No. 298,172, filed Aug. 31, 1981, now abandoned.

The present invention relates to a magnetic toner apparatus for developing an electrostatic latent image formed on the surface of an image carrier such as a photosensitive member.

Recently, in the field of electrophotographic copying machines, facsimiles, printers and similar machines, such a developing method is becoming popular as adapted to develop an electrostatic latent image on the surface of a photosensitive member or a dielectric member by means of a magnetic brush while using magnetic toner. A so-called hard copy is obtainable by directly fixing the image developed by the magnetic toner or by transferring the developed image to a transfer sheet and then fixing the transferred image.

As shown in U.S. Pat. No. 4,240,375 conventional magnetic brush developing devices using magnetic toner cannot make a uniform supply of the toner over the whole effective developing width, and these conventional device are not designed to permit control of the amount of magnetic toner particles being fed.

Accordingly, an object of the invention is to provide a developing device using a magnetic toner, capable of uniformly supplying the magnetic toner and permitting control of the amount of magnetic toner attracted to the sleeve.

To this end, according to the invention, there is provided a developing device using a magnetic toner, having a non-magnetic cylindrical sleeve disposed opposite the surface of a photosensitive member, a magnet roll disposed in the sleeve and having a plurality of magnetic poles, a developing tank adapted for supplying the non-magnetic sleeve with a magnetic toner, a toner tank communicating with the developing tank and containing the magnetic toner, a blade disposed at the toner outlet of the developing tank and adapted to adjust the thickness of the magnetic toner which is conveyed on the sleeve due to the relative rotation between the sleeve and the magnetic roll, means disposed at the upstream side of the blade as viewed in the direction of convey of the magnetic toner and adapted for detecting the amount of the magnetic toner, magnetic means disposed at the toner outlet of the toner tank and adapted to adjust the amount of the magnetic toner supplied through the toner outlet to the developing tank, and actuating means adapted for actuating the magnetic means in accordance with the signal from the detecting means.

Figure 1:
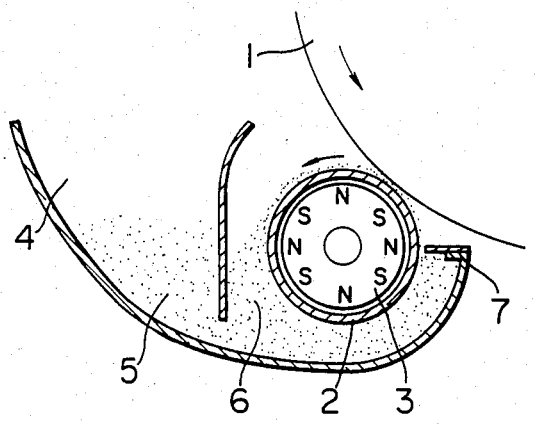
FIG. 1 PRIOR ART
Figure 2:
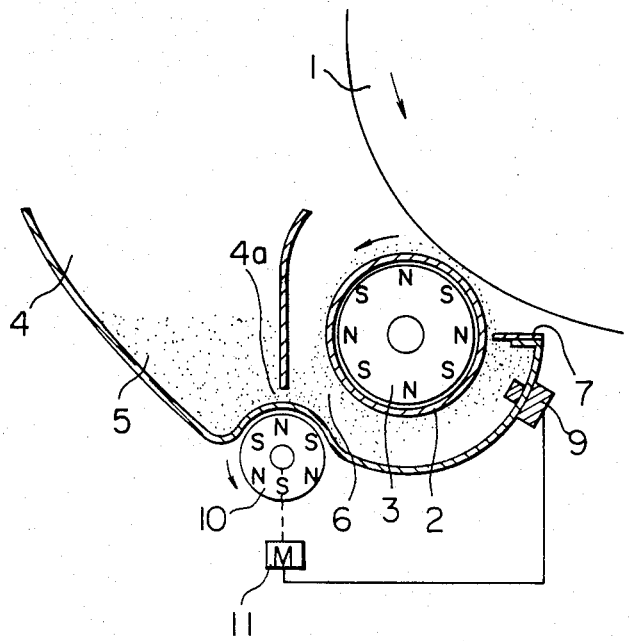

The above and other objects, as well as advantageous features of the invention, will become clear from the following description of a preferred embodiment taken in conjunction with the accompanying drawings, in which:

FIG. 1 is a sectional view of a typical conventional developing device using a magnetic toner; and FIG. 2 is a sectional view of a developing device using a magnetic toner, constructed in accordance with a preferred embodiment of the invention.

Before turning to the detailed description of the preferred embodiment, a description will be made as to the drawbacks of the conventional developing device, in order to facilitate understanding of the advantages of the present invention.

Referring to FIG. 1 showing a typical conventional magnetic brush type developing device using a magnetic toner, a non-magnetic cylindrical sleeve 2 is disposed opposite the photosensitive drum 1. A magnet roll 3 having a plurality of alternating magnetic poles on its periphery is disposed in the sleeve 2. A toner tank 4 containing a magnetic toner 5 is connected to a developing tank 6 so as to supply the latter with the magnetic toner 5. The magnetic toner 5 is then attracted and spread over the surface of the sleeve 2 due to relative rotation between the sleeve 2 and the magnet roll 3. The thickness of the layer of the magnetic toner conveyed on the sleeve 2 is regulated by a blade 7 disposed at the toner outlet of the developing tank 6. The development of image is achieved as the magnetic brush formed by the magnetic toner 5 rubs the surface of the photosensitive drum 1.

In the conventional developing apparatus having the described construction, the supply of the magnetic toner 5 from the toner tank 4 into the developing tank 6 is achieved by voluntarily descending properties thereof due to the force of the gravity. It is, therefore, not possible to supply the magnetic toner uniformly over the entire length of the developing tank 6. In addition, since there is no means for controlling the supply of the magnetic toner from the toner tank 4, the sleeve 2 attracts an excessively large amount of magnetic toner 5, resulting in an increased driving torque.

These drawbacks of the prior art, however, are completely eliminated by the present invention as will be understood from the following description of the preferred embodiment.

FIG. 2 is a sectional view of a magnetic toner developing apparatus in accordance with a preferred embodiment of the invention, in which the same reference numerals are used to denote the same parts or members as those in FIG. 1.

As in the case of the conventional apparatus shown in FIG. 1, the magnetic toner 5 contained by the toner tank 4 is supplied to a developing tank 6 through a supply port 4*a*, and is attracted and conveyed on a non-magnetic cylindrical sleeve 2 having a magnet roll 3 therein. The thickness of the layer of the magnetic toner is adjusted by means of a blade 7 provided at the toner outlet of the developing tank 6, before the toner is conveyed to the developing section.

In the apparatus of the invention, a detector 9 for detecting the amount of the magnetic toner 5 is disposed at the upstream side of the blade 7 as viewed in the direction of the convey of the toner, the preferable construction of which detector 9 is disclosed in U.S. Pat. No. 4,270,487, or Japanese Laid-Open Patent Publication No. 61939/79. More specifically, this detector 9 is adapted to produce an electric signal in accordance with the amount of magnetic toner 5 attracted and held on the sleeve 2. In this embodiment, the detector 9 does not produce any signal when the amount of the magnetic toner 5 attracted and held on a sleeve 2 is greater than a predetermined amount, but produces the signal when the amount of the magnetic toner is decreased below the predetermined amount. Further details of the detector 9 are shown in Japanese Laid-Open Publication No. 153037/79.

A magnet roll 10 having 1000 gauss of magnetic flux density on the surface thereof and provided on its surface with at least two pieces of axially extending magnet poles is disposed in the vicinity of the supply port 4*a* for rotation in the direction of an arrow by a motor 11 or like driving means. The magnet roll 10 is preferably provided with the same axial length as that of the roll 3. The motor 11 is adapted to be actuated in accordance with the signal from the detector 9. The magnet roll 10 has preferably a diameter between 10 and 20 mm and may be rotated at a rate between 100 and 200 r.p.m.

This developing apparatus operates in a manner explained hereinbelow. When the magnetic toner 5 is received in the toner tank 4 for the first time, the detector 9 produces an electric signal because there is no magnetic toner on the sleeve 2. In response to the electric signal the motor 11 is actuated and the magnet roll 10 is rotated in the direction of the arrow. In consequence, the magnetic toner 5 is supplied to the developing tank 6 from the toner tank 4 through the supply port 4*a*. The magnetic toner 5 supplied to the developing tank 6 is attracted and held on the sleeve 2 by the magnetic attracting force of the magnet roll 3, and is conveyed in the direction of the arrow due to relative rotation between the sleeve 2 and the magnet roll 3. In the course of this movement of the magnetic toner 5, the thickness of the layer of the magnetic toner is adjusted by the blade 7. The magnetic toner is returned into the developing tank 6, after development of the electrostatic latent image on the photosensitive drum 1.

As the magnetic toner 5 is continuously supplied from the toner tank 4 into the developing tank 6, the amount of magnetic toner 5 held on the sleeve 2 is increased. When the predetermined amount of the magnetic toner 5 is reached, the electric signal from the detector 9 is stopped and the magnet roll 10 stops rotating and ceases supplying the magnetic toner 5 from the toner tank 4 into the developing tank 6. It is thus possible to prevent the accumulation of an excessive amount of magnetic toner 5 on the sleeve 2 and, therefore, to greatly reduce the torque needed for driving the sleeve 2 and/or the magnet roll 3. At the same time, the stability of the toner is increased. In the conventional apparatus, there is a drawback in that only toner particles of small sizes are consumed while toner particles of comparatively large sizes are left unconsumed. This drawback is completely eliminated in the developing apparatus of the invention. In addition, since the supply of magnetic particles to the developing tank 6 is achieved by the magnetic roll 10, it is possible to supply the toner substantially uniformly over the entire length of the magnet roll 10 so that the magnetic toner 5 is spread on the surface of the sleeve 2 uniformly over the entire effective developing breadth to eliminate any uneven thickness of development.

In the described embodiment, the relative rotation between the magnet roll 3 and the sleeve 2 may be effected by rotating either one of the magnet roll 3 and the sleeve 2 or by rotating these members in opposite directions or in the same direction at different speeds.

As to the detector 9, various types of detectors such as a mechanical detector, a magnetic detector or an optical detector can be used as the detector 9, provided that they can satisfactorily detect the amount of magnetic toner attracted to the sleeve 2. Also, the magnet roll 10 for supplying the magnetic toner 5 may be surrounded by a non-magnetic cylindrical sleeve. Although each of the magnet rolls 3 and 10 has been described as being an integral cylindrical magnet, this is not the only arrangement, e.g., each magnet roll may be composed of a plurality of magnet blocks adhered to one another. It is to be understood also that the described alternating arrangement of N and S poles is not essential and the arrangement of polarities can be modified as required.

The gap $d_1$ between the sleeve 2 and the blade 7 and the gap $d_2$ between the photosensitive drum 1 and the sleeve 2 can be determined in accordance with the method of conveyance of the toner. Namely, if the conveyance of the tone is made by the rotation of the sleeve, the gaps $d_1$ and $d_2$ are preferably selected to fall between 0.3 and 0.6 mm and between 0.5 and 0.8 mm, respectively. In the case where the magnet roll is rotated, the gaps $d_1$ and $d_2$ are preferably selected to range between 0.2 and 0.4 mm and between 0.3 and 0.6 mm, respectively. Finally, if conveyance of the toner is made by simultaneous rotation of the sleeve and the magnet roll, the gaps $d_1$ and $d_2$ are determined to fall between 0.2 and 0.4 mm and between 0.4 and 0.7 mm, respectively. The gap $d_3$ of the toner supply port is selected preferably to be between 0.5 and 2 mm, although it can be varied depending on factors such as the volume of the toner tank 4, the magnetic flux density of the magnet roll 3 and the magnetic flux density on the inner wall of the toner supply port which is preferably within a range of not less than 300 gauss, and so forth.

As has been described, according to the invention, it is possible to supply the magnetic toner uniformly over the entire length of the sleeve and to optimize the amount of the magnetic toner attracted to the sleeve, thereby to ensure a stable development o-f the latent image.

What is claimed is:

1. An apparatus for developing an electrostatic latent image by means of a single component magnetic toner, having a non-magnetic cylindrical sleeve disposed to oppose a surface of a photo-sensitive member, and a magnetic roll disposed in said sleeve and having a plurality of magnetic poles, said apparatus further comprising:

a container provided with developing tank means for receiving the magnetic toner to be supplied onto the non-magnetic cylindrical sleeve and for receiving any excess magnetic toner carried by said sleeve and not transferred to said latent image, said container further including toner supply tank means for holding a supply of the magnetic toner, said toner supply tank means being in communication with said developing tank means via a communication portion including a wall;

a doctor blade disposed at a toner outlet of said developing tank means and adapted to adjust the thickness of a layer of the magnetic toner conveyed to said latent image on said non-magnetic sleeve due to relative rotation between said non-magnetic sleeve and said magnet roll;

means for detecting the amount of the magnetic toner attracted onto said non-magnetic sleeve and for generating a signal in response to said detected amount, said detecting means being disposed in the developing tank means upstream of said doctor blade as viewed in the direction of conveyance of the magnetic toner;

rotating means for supplying the magnetic toner from the toner supply tank means to the developing tank means, said rotating means comprising a magnet roll with a plurality of magnetic poles provided on a surface thereof, and being disposed to control the flow of toner through said communication portion, said magnet roll positioned adjacent said communication wall and being rotatable in a predetermined direction to move the magnetic toner from said toner supply tank means to said developing tank means along said wall; and means for actuating said rotating means in accordance with the signal generated by said detecting means, thereby controlling the delivery of the magnetic toner from said toner supply tank means to said developing tank means based on the amount of toner in said developing tank means.

2. A developing apparatus as claimed in claim 1, wherein said actuating means are actuated such that the magnet roll of said rotating means is rotated until said detected amount of magnetic toner reaches a predetermined level, and the magnet roll of said rotating means is stopped whenever said detected amount of magnetic toner reaches said predetermined level.

3. A developing apparatus as claimed in claim 1, wherein said magnet roll and said magnetic roll are of substantially equal length.

* * * * *